US010115492B2

(12) United States Patent
Richmond et al.

(10) Patent No.: US 10,115,492 B2
(45) Date of Patent: Oct. 30, 2018

(54) ELECTRICALLY CONDUCTIVE CARBON NANOTUBE WIRE HAVING A METALLIC COATING AND METHODS OF FORMING SAME

(71) Applicant: Delphi Technologies, Inc., Troy, MI (US)

(72) Inventors: Zachary J. Richmond, Warren, OH (US); Evangelia Rubino, Warren, OH (US); Gina Sacco, Warren, OH (US); George Albert Drew, Warren, OH (US); Gregory V. Churley, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/441,599

(22) Filed: Feb. 24, 2017

(65) Prior Publication Data

US 2018/0247724 A1 Aug. 30, 2018

(51) Int. Cl.

| | |
|---|---|
| ***H01B 7/00*** | (2006.01) |
| ***H01B 1/04*** | (2006.01) |
| ***H01B 1/02*** | (2006.01) |
| ***H01B 5/08*** | (2006.01) |
| ***H01B 7/02*** | (2006.01) |

(Continued)

(52) U.S. Cl.

CPC ..... *H01B 1/04* (2013.01); *H01B 1/026* (2013.01); *H01B 5/08* (2013.01); *H01B 7/02* (2013.01); *H01B 13/0016* (2013.01); *H01B 13/0036* (2013.01); *H01R 4/023* (2013.01); *H01R 4/184* (2013.01); *H01R 43/02* (2013.01); *H01R 43/048* (2013.01)

(58) Field of Classification Search

CPC . H01B 1/02; H01B 1/04; H01B 1/026; H01B 5/08; H01B 7/02; H01B 13/0016; H01B 13/0036; H01R 43/02; H01R 4/184; H01R 43/048

USPC ..... 174/126.1, 126.2, 102 R, 36

See application file for complete search history.

(56) References Cited

U.S. PATENT DOCUMENTS 5,218,171 A 6/1993 Aldissi
5,969,229 A 10/1999 Hod et al.

(Continued)

FOREIGN PATENT DOCUMENTS

CN 101976594 A 2/2011

OTHER PUBLICATIONS

"Electrodeposition of Nickel onto 12K Carbon Fibre Tow in a Continuous Manner", Boguslaw Pierozynski, Croatica Chemica Acta (2012), ISSN 0011-1643, e-ISSN 1334-417X.

(Continued)

*Primary Examiner* — William H Mayo, III
(74) *Attorney, Agent, or Firm* — Robert J. Myers

(57) ABSTRACT

An attachment device includes a central body formed of a plastic material and defining a cavity configured to receive a temperature probe and a plurality of straps extending from the central body. Each strap of the plurality of straps is configured to secure a cable to the central body. The central body defines a wall having a first side configured to be in contact with the temperature probe and a second side in contact with a cable. This attachment device may notably be used in an electrical connection assembly having a connector, a temperature sensor disposed within the device, and at least two cables.

15 Claims, 2 Drawing Sheets

(51) Int. Cl.

| | |
|---|---|
| ***H01B 13/00*** | (2006.01) |
| ***H01R 4/18*** | (2006.01) |
| ***H01R 4/02*** | (2006.01) |
| ***H01R 43/048*** | (2006.01) |
| ***H01R 43/02*** | (2006.01) |

(56) References Cited

U.S. PATENT DOCUMENTS

| | | | | |
|---|---|---|---|---|
| 8,354,593 | B2 | 1/2013 | White et al. | |
| 2003/0135971 | A1* | 7/2003 | Liberman | B01D 67/0041 29/419.1 |
| 2008/0283267 | A1* | 11/2008 | Werth | H01B 1/04 174/68.1 |
| 2009/0173516 | A1* | 7/2009 | Burke | B82Y 10/00 174/126.1 |
| 2009/0194313 | A1 | 8/2009 | Jiang et al. | |
| 2009/0196981 | A1 | 8/2009 | Liu et al. | |
| 2009/0196985 | A1 | 8/2009 | Jiang et al. | |
| 2009/0197082 | A1* | 8/2009 | Jiang | H01B 1/04 428/367 |
| 2010/0101828 | A1* | 4/2010 | Duarte Pena | C09D 7/1291 174/120 C |
| 2010/0230132 | A1* | 9/2010 | Swift | A61B 5/00 174/119 R |
| 2011/0005808 | A1* | 1/2011 | White | H01B 1/026 174/126.2 |
| 2012/0090866 | A1* | 4/2012 | Gundel | H01B 7/0861 174/34 |
| 2012/0228019 | A1* | 9/2012 | Ermolov | B82Y 30/00 174/377 |
| 2013/0233595 | A1* | 9/2013 | Cooper | H01B 5/002 174/126.2 |
| 2014/0224524 | A1* | 8/2014 | Gazda | H01B 1/04 174/126.2 |
| 2017/0233579 | A1* | 8/2017 | Yushin | C01F 7/30 427/212 |

OTHER PUBLICATIONS

Hannula Pyry-Mi Kko et al: "Carbon 1-13 Nanotube-copper Composites by Electrodeposition on Carbon Nanotube Fibers", Carbon, Elsevier, Oxford, GB, vol. 107,Jun. 3, 2016 (Jun. 3, 2016), pp. 281-287, XP029644361, ISSN: 0008-6223, 001:10.1016/J. CARBON. Jun. 8, 2016.

* cited by examiner

ELECTRICALLY CONDUCTIVE CARBON NANOTUBE WIRE HAVING A METALLIC COATING AND METHODS OF FORMING SAME

TECHNICAL FIELD OF THE INVENTION

The invention generally relates to electrical wires, and more particularly relates to an electrical wire formed of a carbon nanotube strand(s) having a metallic coating.

BACKGROUND OF THE INVENTION

Traditionally automotive electrical cables were made with copper wire conductors which may have a mass of 15 to 28 kilograms in a typical passenger vehicle. In order to reduce vehicle mass to meet vehicle emission requirements, automobile manufacturers have begun also using aluminum conductors. However, aluminum wire conductors have reduced break strength and reduced elongation strength compared to copper wire of the same size and so are not an optimal replacement for wires having a cross section of less than 0.75 $mm^2$ (approx. 0.5 mm diameter). Many of the wires in modern vehicles are transmitting digital signals rather than carrying electrical power through the vehicle. Often the wire diameter chosen for data signal circuits is driven by mechanical strength requirements of the wire rather than electrical characteristics of the wire and the circuits can effectively be made using small diameter wires.

Stranded carbon nanotubes (CNT) are lightweight electrical conductors that could provide adequate strength for small diameter wires. However, CNT strands do not currently provide sufficient conductivity for most automotive applications. CNT strands are not easily terminated by crimped on terminals. Additionally, CNT strands are not terminated without difficulty by soldered on terminals because they do not wet easily with solder.

Therefore, a lower mass alternative to copper wire conductors for small gauge wiring remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with a first embodiment of the invention, an electrical conductor is provided. The electrical conductor includes an elongated strand consisting essentially of carbon nanotubes having a length of at least 50 millimeters and a conductive coating covering an outer surface of the strand, wherein the conductive coating has greater electrical conductivity than the strand. The conductive coating may consist essentially of a metallic material such as tin, nickel, copper, gold, or silver. The conductive coating may have a thickness of 10 microns or less. The conductive coating may be applied to the outer surface by a process such as electroplating, electroless plating, draw cladding, or laser cladding.

In accordance with a second embodiment of the invention, a multi-strand electrical wire assembly is provided. The multi-strand electrical wire assembly includes a plurality of electrical conductors as described in the preceeding paragraph. The assembly may further include an electrical terminal crimped to an end of the assembly. The terminal may be soldered or crimped to an end of the assembly. The assembly may also include an insulative jacket formed of a dielectric polymer material covering the conductive coating.

In accordance with a third embodiment of the invention, a method of manufacturing an electrical conductor is provided. The method includes the steps of providing an elongated strand consisting essentially of carbon nanotubes having a length of at least 50 millimeters and covering an outer surface of the strand with a conductive coating having greater electrical conductivity than the strand. The conductive coating may consist essentially of a metallic material such as tin, nickel, copper, gold, and silver. The conductive coating may have a thickness of 10 microns or less. The step of covering the outer surface of the strand may include sub-steps of placing the strand in an ionic solution of the metallic material and passing an electric current through the strand. Alternatively, the step of covering the outer surface of the strand may include the sub-steps of wrapping the outer surface of the strand with a thin layer of the metallic material and drawing the strand through a mandrel. As an another alternative, the step of covering the outer surface of the strand may include the sub-steps of applying a powder of the metallic material to the outer surface of the strand and applying heat to sinter the powdered metallic material. The sub-step of applying heat may be performed using a laser. As yet another alternative, the step of covering the outer surface of the strand may include using an electroless plating process to apply the metallic material to the outer surface of the strand.

In accordance with a fourth embodiment of the invention, another multi-strand electrical wire assembly is provided. The assembly is formed by a process comprising the steps of providing an elongated strand consisting essentially of carbon nanotubes and having a length of at least 50 millimeters and covering an outer surface of each strand with a metallic material having greater electrical conductivity than the strand. The metallic material is tin, nickel, copper, gold, or silver. The process further includes the step of arranging the plurality of strands such that there is one central strand surrounded by the remaining strands in the plurality of strands. The step of covering an outer surface of each strand may be performed using a process such as electroplating, electroless plating, draw cladding, or laser cladding. The process may further include the steps of providing an electrical terminal and crimping or soldering the electrical terminal to an end of the plurality of strands.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
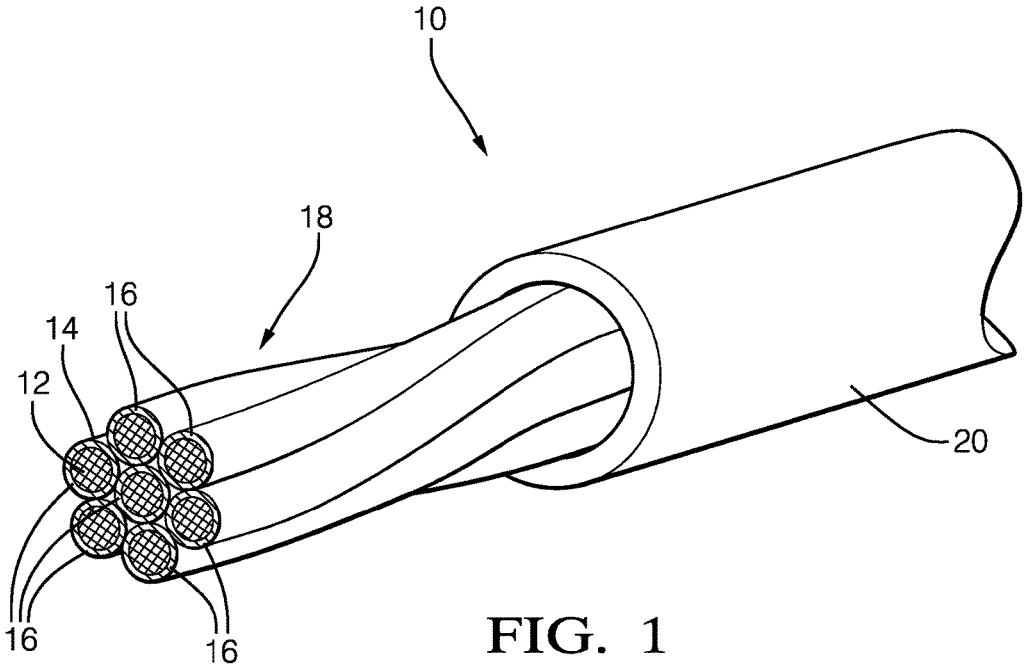
FIG. 1 is a perspective view of a multi-strand composite electrical conductor assembly in accordance with one embodiment.

Carbon nanotube (CNT) conductors provide improved strength and reduced density as compared to stranded metallic conductors. CNT strands have 160% higher tensile strength compared to a copper strand having the same diameter and 330% higher tensile strength compared to an aluminum strand having the same diameter. In addition, CNT strands have 16% of the density of the copper strand and 52% of the density of the aluminum strand. However, CNT strands have 16.7 times higher resistance compared to the copper strand and 8.3 times higher resistance compared to the aluminum strand resulting in reduced electrical conductivity.

To overcome this reduced conductivity, a metallic coating can be added to a carbon nanotube strand to improve electrical conductivity while retaining the benefits of increased strength, reduced weight, and reduced diameter. To form the coated CNT strand, electroplating, electroless plating, and cladding processes can be used. The metal coating will also provide crimping and soldering performance needed to terminate the conductor.

Cladding a CNT strand could be done through a drawing process, similar to drawing of traditional copper and aluminum wires. A thin layer of metal may be wrapped around the CNT strand and then pulled through a drawing mandrel to compress or compact the two materials together. Compaction of CNT strands has also been theorized to improve conductivity due to removal of free space between the carbon nanotubes. Alternatively, laser cladding of metal power to CNT strand could be used to apply the metallic coating to the CNT strand.

An electroplating process could also be used to bond the metal coating to the CNT strand as well. As the electrical conductivity of CNT strands is near the electrical conductivity of metals, an electrical current is passed through the CNT strand as it is pulled through an ionic solution of metals. The metal ions are attracted to the CNT strand and are deposited on the outer surface, creating a metal coating on the CNT strand.

As a further alternative, an electroless plating process may be used to apply the metallic coating to the CNT strand. The CNT strand is passed through various solutions to apply a metal plating to the outer surface of the CNT strand. This process is similar to electroplating, however, it uses chemical process rather than electrochemical processes and does not require an electrical current for the plating to occur.

A metal coating of nickel or tin may be preferred, but a coating of copper, silver, or gold (or their alloys) may also be used depending on conductivity requirements of the conductor. Additionally, multiple layers of the same or different metals may be used through multiple electroless and/or electroplating processes.

Various pre-treatment methods may be needed for the various methods described. These pre-treatment methods should be familiar to those skilled in the art. A preferred thicknesses of the coating is about 10 μm, however the thickness of the coating may be changed to reach conductivity required of the conductor.

The end result is a composite conductor formed of a metallic coated CNT strand. The composite conductor exhibits higher electrical conductivity due to the metal plating, but with the strength and almost the same weight as the CNT strand. This allows for downsizing of wire cables due to the higher strength of the composite conductor with a reduced diameter. The weight of the composite conductor will be slightly greater than the weight of the CNT strand due to metal plating, but the composite conductor will provide a large weight reduction compared to metallic conductors, allowing for light weighting of wire cables.

The high tensile strength of the CNT stands allow smaller diameter conductors having high tensile strength while the conductive provides adequate electrical conductivity, particularly in digital signal transmission applications. The low density of the CNT strands also provide a weight reduction compared to metallic strands.

FIG. 1 illustrates a non-limiting example of an elongated electrical conductor 10 having strands 12 that are at least 50 millimeters long consisting essentially of carbon nanotubes. In automotive applications, the strands 12 may have a length of up to 7 meters. The carbon nanotubes (CNT) strands 12 are formed by spinning carbon nanotube fibers having a length ranging from about several micron to several millimeters into a strand or yarn having the desired length and diameter. The processes for forming the CNT stands 12 may use wet or dry spinning processes that are familiar to those skilled in the art.

The outer surface of each CNT strand 12 is covered by a conductive coating 14 which has greater electrical conductivity than the CNT strand 12, thereby forming a composite wire strand 16. The conductive coating 14 in the illustrated is tin, but the conductive coating 14 may alternatively or additionally consist of a metallic material such as tin, nickel, copper, gold, or silver. As used herein, the terms "tin, nickel, copper, gold, and silver" mean the elemental form of the named element or an alloy wherein the named element is the primary constituent. The conductive coating 14 has a thickness of 10 microns or less. The conductive coating 14 may be applied to the outer surface by a process such as electroplating, electroless plating, draw cladding, or laser cladding which will each be explained in greater detail later.

As illustrated in FIG. 1, the composite wire strands 16 are formed into a composite wire cable 18 having a central composite wire strand 16 surrounded by six other composite wire strands 16 that are twisted about the central strand. Other embodiments of the invention may include more or fewer composite wire strands arranged in other cable configurations familiar to those skilled in the art. The number and the diameter of the composite wire strands 16 as well as the thickness of the conductive coating 14 will be driven by design considerations of mechanical strength, electrical conductivity, and electrical current capacity. The length of the composite wire cable 18 will be determined by the particular application of the composite wire cable 18.

The composite wire cable 18 is encased within an insulation jacket 20 formed of a dielectric material such as polyethylene (PE), polypropylene (PP), polyvinylchloride (PVC), polyamide (NYLON), or polytetrafluoroethylene (PFTE). The insulation jacket 20 may preferably have a thickness between 0.1 and 0.4 millimeters. The insulation jacket 20 may be applied over the composite wire cable 18 using extrusion processes well known to those skilled in the art.

Figure 2:
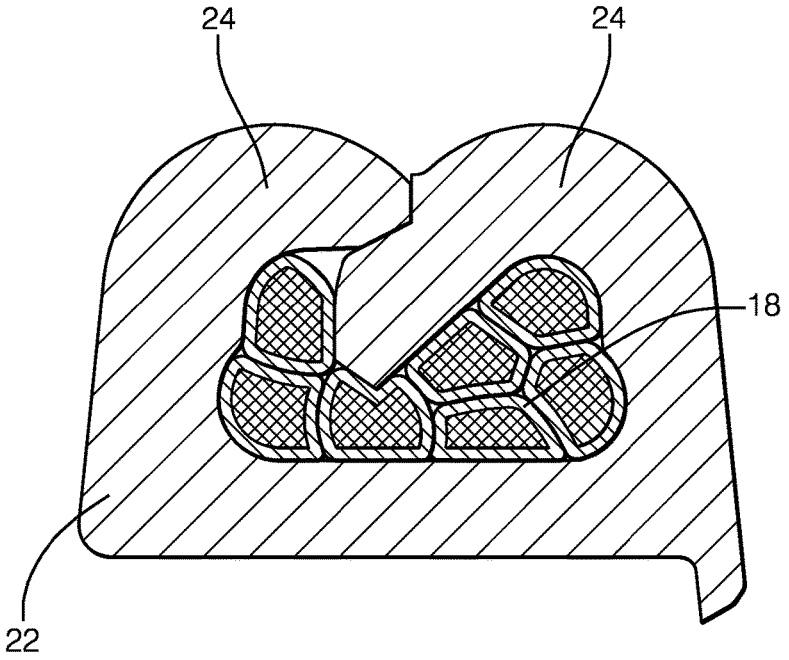
FIG. 2 is a cross section view of a terminal crimped to the multi-strand composite electrical conductor assembly of FIG. 1 in accordance with one embodiment.

As illustrated in FIG. 2, an end of the composite wire cable 18 is terminated by an electrical terminal 22 having a pair of crimping wings 24 that are folded over the composite wire cable 18 and are compressed to form a crimped connection between the composite wire cable 18 and the electrical terminal 22. The inventors have discovered that a satisfactory connection between the composite wire cable 18 and the electrical terminal 22 can be achieved using conventional crimping terminals and crimp forming techniques.

Alternatively, the electrical terminal 22 may be soldered to the end of the composite wire.

Figure 3:
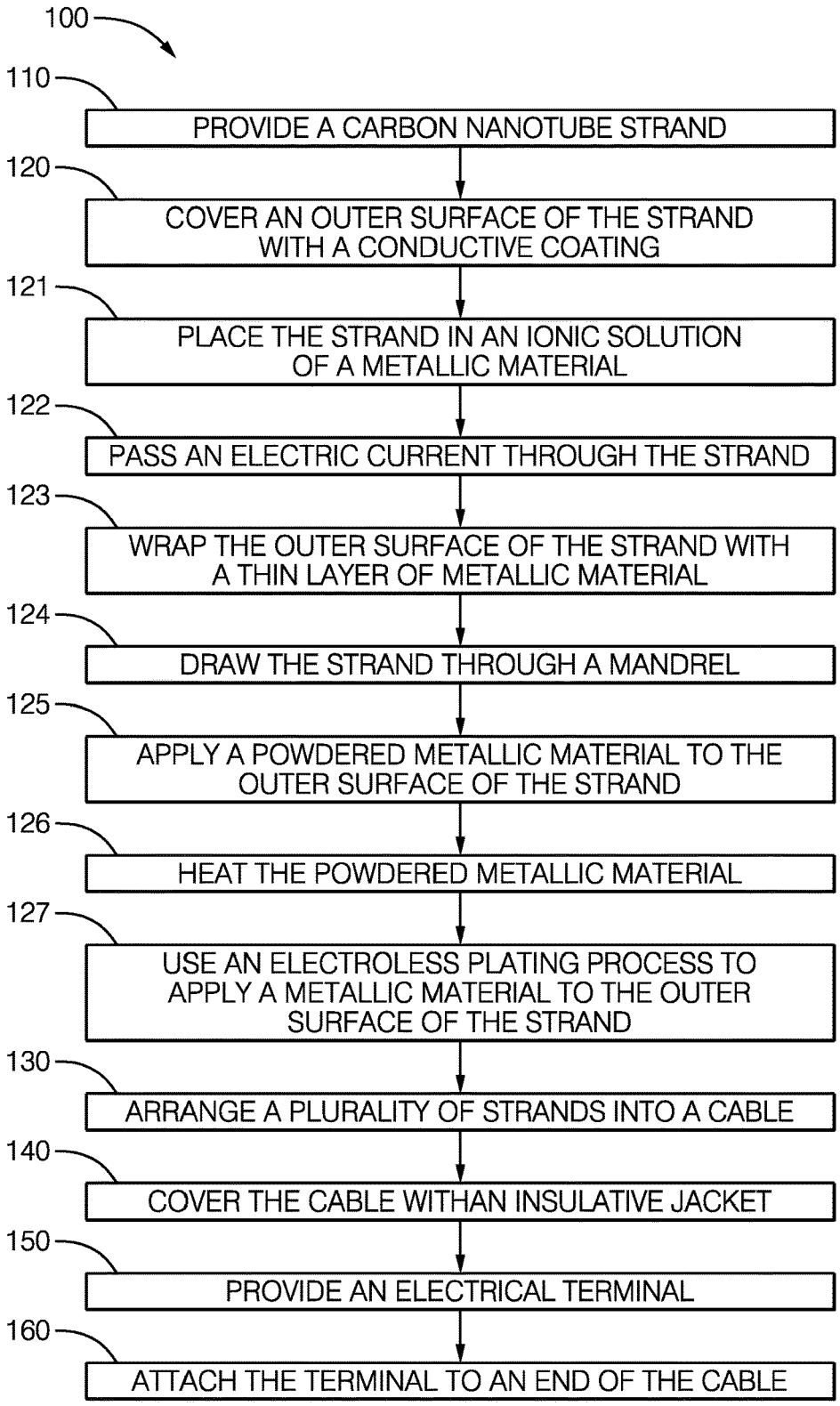
FIG. 3 is a flow chart of a method of forming a composite electrical conductor assembly in accordance with another embodiment.

FIG. 3 illustrates a non-limiting method 100 of forming a resilient seal about a work piece. The method 100 includes the following steps.

STEP 110, PROVIDE A CARBON NANOTUBE STRAND, includes providing an elongated strand consisting essentially of carbon nanotubes having a length of at least 50 millimeters. The carbon nanotube (CNT) strand 12 is formed by spinning carbon nanotube fibers having a length ranging from about several micron to several millimeters into a strand or yarn having the desired length and diameter. The processes for forming CNT stands 12 may use wet or dry spinning processes that are familiar to those skilled in the art.

STEP 120, COVER AN OUTER SURFACE OF THE STRAND WITH A CONDUCTIVE COATING, includes covering an outer surface of the CNT strand 12 with a conductive coating 14 that has a greater electrical conductivity than the CNT strand 12, thereby forming a composite wire strand 16. The conductive coating 14 may consist essentially of a metallic material such as tin, nickel, copper, gold, and/or silver. The conductive coating 14 may have a thickness of 10 microns or less. The conductive coating 14 may include one or more of the metallic material listed.

STEP 121, PLACE THE STRAND IN AN IONIC SOLUTION OF A METALLIC MATERIAL, is a sub-step of STEP 120 and includes placing the CNT strand 12 in a bath including an ionic solution of the metallic material, such as tin, nickel, copper, gold, or silver as a first step of an electroplating process. The chemicals and solution concentration required for electroplating CNT strands are well known to those skilled in the art.

STEP 122, PASS AN ELECTRIC CURRENT THROUGH THE STRAND, is a sub-step of STEP 120 and includes passing an electric current through the CNT strand 12 while it is in the bath including the ionic solution of the metallic material as a second step of the electroplating process. The electrical current required for electroplating CNT strands are well known to those skilled in the art.

STEP 123, WRAP THE OUTER SURFACE OF THE STRAND WITH A THIN LAYER OF METALLIC MATERIAL, is a sub-step of STEP 120 and includes wrapping the outer surface of the CNT strand 12 with a thin layer of the metallic material, such as tin, nickel, copper, gold, or silver foil as a first step of an draw cladding process.

STEP 124, DRAW THE STRAND THROUGH A MANDREL, is a sub-step of STEP 120 and includes pulling the CNT strand 12 wrapped with the metallic foil through a mandrel configured to compress the foil and CNT strand 12 as it is pulled though as a second step of the draw cladding process.

STEP 125, APPLY A POWDERED METALLIC MATERIAL TO THE OUTER SURFACE OF THE STRAND, is a sub-step of STEP 120 and includes applying a powder of the metallic material, such as tin, nickel, copper, gold, or silver to the outer surface of the CNT strand 12 as a first step of a laser cladding process.

STEP 126, HEAT THE POWDERED METALLIC MATERIAL, is a sub-step of STEP 120 and includes heating the powdered metallic material by irradiating the powered with a laser, thereby sintering the metallic material to the CNT strand 12 as a second step of the laser cladding process.

STEP 127, HEAT THE POWDERED METALLIC MATERIAL, is a sub-step of STEP 120 and includes using an electroless plating process to apply the metallic material, such as tin, nickel, copper, gold, or silver to the outer surface of the CNT strand 12. The chemicals and solution concentration required for electroless plating of CNT strands are well known to those skilled in the art.

STEPS 121 through 127 may be repeated or combined to apply multiple layers of the conductive coating 14, e.g. a first coating, such as nickel, followed by a second coating, such as copper in order to improve the adhesion properties of the second coating.

STEP 130, ARRANGE A PLURALITY OF STRANDS INTO A CABLE, includes arranging the plurality of composite wire strands 16 into a composite wire cable 18 such that there is one central composite wire strand 16 is surrounded by the remaining composite wire strands 16 as illustrated in FIG. 1.

STEP 140, COVER THE CABLE WITH AN INSULATIVE JACKET, includes encasing the composite wire cable 18 formed in STEP 130 within an insulation jacket 20 as illustrated in FIG. 1. The insulation jacket 20 is formed of a dielectric material such as polyethylene (PE), polypropylene (PP), polyvinylchloride (PVC), polyamide (NYLON), or polytetrafluoroethylene (PFTE). The insulation jacket 20 may preferably have a thickness between 0.1 and 0.4 millimeters. The insulation jacket 20 may be applied over the composite wire cable 18 using extrusion processes well known to those skilled in the art.

STEP 150, PROVIDE AN ELECTRICAL TERMINAL, includes providing an electrical terminal 22 configured to terminate an end of the composite wire cable 18.

STEP 160, ATTACH THE TERMINAL TO AN END OF THE CABLE, includes attaching the electrical terminal 22 to an end of the composite wire cable 18. The electrical terminal 22 may be attached by a crimping process as illustrated in FIG. 2. The inventors have determined that a satisfactory connection between the composite wire cable 18 and the electrical terminal 22 can be achieved using conventional crimping terminals and crimp forming techniques. Alternatively, the electrical terminal 22 may be soldered to the end of the composite wire cable 18.

Accordingly, a composite wire strand 16, a composite wire cable 18, a multi-strand composite electrical conductor assembly 10, and method 100 for producing any of these are provided. The composite wire strand 16 and composite wire cable 18 provides the benefit of a reduced diameter and weight compared to a metallic wire and stranded metallic wire cable having the same tensile strength while still providing adequate electrical conductivity and current capacity for many applications, especially digital signal transmission.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A multi-strand electrical wire assembly comprising:

a plurality of elongate strands consisting essentially of carbon nanotubes having a length of at least 50 millimeters;

a conductive coating covering an outer surface of the plurality of carbon nanotube strands having greater electrical conductivity than the plurality of carbon nanotube strands; and an electrical terminal attached to an end of the assembly by an attachment means selected from the list consisting of soldering and crimping.

2. The multi-strand electrical wire assembly according to claim 1, wherein the conductive coating consists essentially of a metallic material selected from the list consisting of tin, nickel, copper, gold, and silver.

3. The multi-strand electrical wire assembly according to claim 2, wherein the conductive coating has a thickness of 10 microns or less.

4. The multi-strand electrical wire assembly according to claim 1, wherein the conductive coating is applied to the outer surfaces of the plurality of elongate strands by a process selected from the list consisting of electroplating, electroless plating, draw cladding, and laser cladding.

5. The multi-strand electrical wire assembly according to claim 1, further comprising an insulative jacket formed of a dielectric polymer material covering the plurality of elongate strands.

6. A method of manufacturing an electrical conductor, comprising the steps of:

providing a plurality of elongate strands consisting essentially of carbon nanotubes having a length of at least 50 millimeters; and covering an outer surface of the plurality of carbon nanotube strands with a conductive coating having greater electrical conductivity than the plurality of carbon nanotube strands; and providing an electrical terminal, wherein the process further comprises at least one step selected from the list comprising of:

crimping the electrical terminal to an end of the plurality of carbon nanotube strands; and soldering the electrical terminal to an end of the plurality of carbon nanotube strands.

7. The method according to claim 6, wherein the conductive coating consists essentially of a metallic material selected from the list consisting of tin, nickel, copper, gold, and silver.

8. The method according to claim 7 wherein the conductive coating has a thickness of 10 microns or less.

9. The method according to claim 8, wherein the step of covering the outer surface of the plurality of carbon nanotube strands includes the sub-steps of placing the plurality of carbon nanotube strands in an ionic solution of the metallic material and passing an electric current through the carbon nanotube strand.

10. The method according to claim 7, wherein the step of covering the outer surface of the plurality of carbon nanotube strands includes the sub-steps of wrapping the outer surface of the plurality of carbon nanotube strands with a thin layer of the metallic material and drawing the plurality of carbon nanotube strands through a mandrel.

11. The method according to claim 7, wherein the step of covering the outer surface of the plurality of carbon nanotube strands includes the sub-steps of applying a powder of the metallic material to the outer surface of the plurality of carbon nanotube strands and applying heat to sinter the powdered metallic material.

12. The method according to claim 11, wherein the sub-step of applying heat is performed using a laser.

13. The method according to claim 7, wherein the step of covering the outer surface of the plurality of carbon nanotube strands includes using an electroless plating process to apply the metallic material to the outer surface of the carbon nanotube strand.

14. A multi-strand electrical wire assembly formed by a process comprising the steps of:

providing a plurality of elongate strands consisting essentially of carbon nanotubes having a length of at least 50 millimeters;

covering an outer surface of each carbon nanotube strand with a metallic material having greater electrical conductivity than the strand, wherein the metallic material is selected from the list consisting of tin, nickel, copper, gold, and silver;

arranging the plurality of carbon nanotube strands such that one central strand is surrounded by the remaining strands in the plurality of strands; and providing an electrical terminal, wherein the process further comprises at least one step selected from the list comprising of:

crimping the electrical terminal to an end of the plurality of carbon nanotube strands; and soldering the electrical terminal to an end of the plurality of carbon nanotube strands.

15. The assembly according to claim 14, wherein the step of covering an outer surface of each strand is performed using a process selected from the list consisting of electroplating, electroless plating, draw cladding, and laser cladding.

* * * * *